United States Patent [19]

Müller et al.

[11] Patent Number: 4,608,210

[45] Date of Patent: Aug. 26, 1986

[54] METHOD FOR PRODUCING PLASTICALLY BONDED PROPULSION POWDERS AND EXPLOSIVES

[75] Inventors: Dietmar Müller, Karlsruhe; Hiltmar Schubert, Walzbachtal, both of Fed. Rep. of Germany

[73] Assignee: Fraunhofer Gesellschaft zur Forderung der angewandten Forschung e. V., Fed. Rep. of Germany

[21] Appl. No.: 659,247

[22] Filed: Oct. 10, 1984

[30] Foreign Application Priority Data

Apr. 3, 1984 [DE] Fed. Rep. of Germany ..... 3412410

[51] Int. Cl.[4] ..... C06B 21/00

[52] U.S. Cl. ..... 264/3.2; 264/3.5; 264/3.6

[58] Field of Search ..... 264/3 R, 3 B, 3 D, 3.1, 264/3.2, 3.4, 3.5, 3.6

[56] References Cited

U.S. PATENT DOCUMENTS

| | | | |
|---|---|---|---|
| 4,120,920 | 10/1978 | Cougoul et al. | 264/3 B |
| 4,405,534 | 9/1983 | Deisenroth | 264/3 D X |
| 4,491,489 | 1/1985 | Ellis et al. | 264/3 D X |

FOREIGN PATENT DOCUMENTS

| | | | |
|---|---|---|---|
| 545817 | 3/1956 | Belgium | 264/3 B |
| 570515 | 2/1959 | Canada | 264/3 B |
| 2308767 | 9/1973 | Fed. Rep. of Germany | 264/3 B |

*Primary Examiner*—Peter A. Nelson

*Attorney, Agent, or Firm*—McCormick, Paulding & Huber

[57] ABSTRACT

A method for manufacturing plastically bonded propulsive powders and explosives by means of an extruder which comprises a housing with at least one entry opening, under certain conditions a solvent supplementing opening, two co- or counterrotating screw shafts and a forming head. The method makes possible continuous production with minimal binder components of 4–6 percent. Firstly, the plastic binder in a fixed, soluble or suspended form is added by means of an entry opening for a period of time until the screws float in the plastic binder without opposing friction and without friction with the walls. The components of the propulsive powder, or correspondingly the explosive material in crystalline form, are added in steadily increasing proportions with a simultaneous reduction of the portion of the plastic binder and finally, the mixture ratio is held constant.

7 Claims, 4 Drawing Figures

METHOD FOR PRODUCING PLASTICALLY BONDED PROPULSION POWDERS AND EXPLOSIVES

Figure 1:
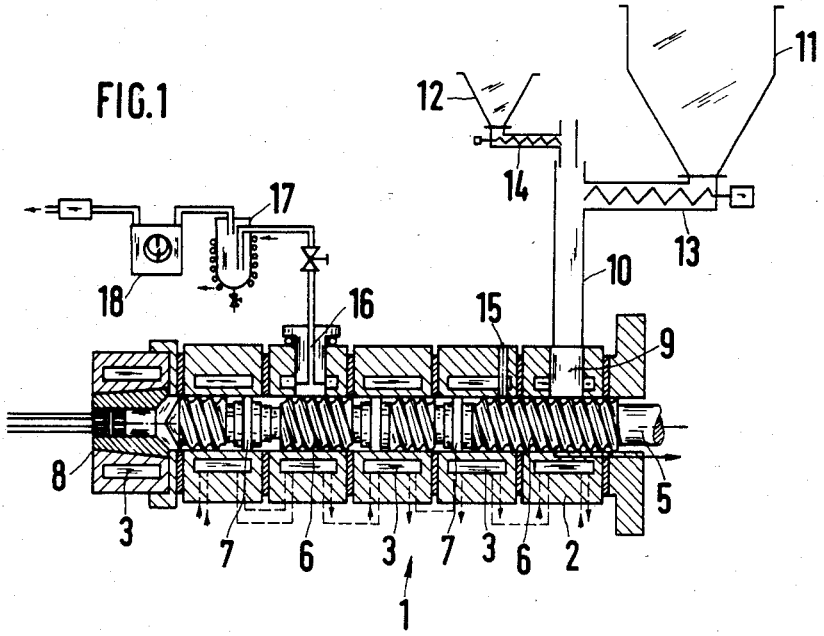

The invention is comprised of a method for producing plastically bonded propulsion powders or explosives by means of an extruder which consists of a housing with at least an entry opening and in some circumstances, a supplemental opening for a solvent, two corotating or counterrotating screw shafts and a forming head.

An extruder of the above-mentioned construction for producing propulsion powders in strand form is known in German patents DE-PS No. 30 44 577 or P No. 32 42 301. These devices permit the production of a single base (nitrocellulose), double-base (nitrocellulose+nitroglycerin or other blasting oils) as well as triple-base (nitrocellulose+nitroglycerin+nitroguanidine) propulsive powders whereby there is constant working with a solvent soaked nitrocellulose. Propulsion powders and explosives are also known which are bound in a plastic matrix. Under these fall crystalline explosives and thereunder firstly hexogene, octogene, or mixtures of both (HMX/RDX), and/or nitroguanidine. In any case, ignition-improving additives can be added, such as nitrocellulose in small amounts (≦7%) or other high-energy polymers. Such plastically bonded propulsion powders or explosives could only be produced in charges or by batch processing in which case the percentage of binder component is relatively high at approximately 15 percent or more.

It is a principal object of the invention to provide a method of the foregoing type that makes it possible to continually produce a plastically bonded propulsion powder or explosive with a simultaneous reduction of the plastic binder component. Further there is proposed a device for performing the method.

Departing from the method of the prior art, the object according to the invention is accomplished by firstly adding the plastic binder in a fixed, soluble, or suspended form through an entry opening for a period of time until the feed screws "float", without resistance or wall friction in the plastic binder and then adding the components of the propulsion powder or correspondingly the explosives in a crystalline form in steadily increasing proportions with a simultaneous reduction in the plastic binder component, and finally holding the mixture ratios constant.

It has been shown that until now the processing of plastically bonded propulsion powders or explosives with high concentrations of crystal components in extruders was regarded to be impossible and that in order to make a continuous manufacturing process possible, firstly, the extruder had to be "underfed" until the friction of the screws relative to one another and to the walls of the housing at idle is eliminated in each extruder. With a full extruder the screws center themselves such that there is very little or no friction present between them and the walls. The screws float in the material which surrounds them. As soon as this condition is reached, the explosive in crystal form is added. In this manner, the danger is eliminated that the crystals themselves are subjected to metallic friction which would lead to considerable endangerment. The crystalline materials are finally added in steadily increasing proportions with a simultaneous reduction of the plastic binder component. Experimental tests have established that the plastic binder component can drop to 4–6 percent so that the component of inert material which lessens the power of the end product is less than in propulsive powders or explosives previously manufactured in batch processes with a plastic bonding matrix. With corresponding configurations of the screws which consist of delivery and kneading segments, one or more propulsive powders or explosive strands can be manufactured continuously. The resulting strands are cut as raw stock and can be made in desired forms by pressing the explosive raw stock, for example for raw charges, or by mechanical working, for example for warheads or fragmentation bombs. In the case of processing the propulsive powders, the strand can be simultaneously provided with the necessary channels or slots during the extrusion process. The extruder is controlled in temperature and dwell time so that the plastic binder is only polymerized or partially hardened to permit the product to be worked still further. As a geometric form for the kneading segments, there is a three-point segment (equilateral triangle with convex sides) or the two-point segment (elliptical cross-section with flattened tips).

According to one embodiment of the method, the plastic binder is added in the form of granules, flakes, or the like and is melted in the extruder at temperatures up to a maximum of 130° C. and after a time delay, the propulsive powder or crystalline explosive components are added in increasing portions.

The temperature and with it the softening or melting temperature of the polymer should not be permitted to exceed 130° for safety reasons. It should in general lie in the range of approximately 100° C. In some cases, a solvent can be added to the softened plastic material in order to assist in the plasticizing, in which case this addition is advantageously performed downstream of the entry opening and the excess solvent is drawn off at a position lying further downstream.

If the plastic binder is added in a suspended form, it serves in certain circumstances to provide a corresponding dehydration of the extruder.

In respect to the technical apparatus, the invention is derived from an extruder which consists of a housing, two corotating or counterrotating screws, at least one entry opening and in some cases a supplemental solvent opening and a forming head. One such device is characteristic of the present invention in that the entry opening is associated with a storage device having a feeder for the plastic binder and further in that a storage device with a feeder is provided for the propulsive powder or crystalline explosive components. The latter container is associated either with the entry opening or a supplemental opening lying downstream of the entry opening. As feeders, there are firstly screw of spiral feeders, preferably differential feeding scales. These are controlled in such a manner that the plastic binder is initially added by itself until the entire extruder is full. Afterwards, the supplemental feeding of the crystalline explosive is injected whereby the ratio of the plastic binder and the crystalline explosive is steadily changed to that which is most favorable until finally the desired mixture ratio is reached with up to 4–6 percent binder component.

The solvent-supplementing opening is advantageously located downstream of the entry opening as long as the polymer already in suspension, which in some cases contains solvent, is not added directly into the entry opening.

Further, the housing of the extruder can include a supplemental opening lying downstream of the inlet opening for a softener. This opening can also be placed near the solvent supplementing opening.

In the case of solvent supplementation, the housing is provided with a suction opening downstream of the supplemental opening for withdrawing excess solvent whereby a recooling and recirculation of the solvent can be provided.

In a further embodiment of the invention the housing is at least partially penetrable by X-rays in order to process in this manner plastics in which polymerization is effected through X-rays.

In accordance with a further embodiment, the housing is at least partially penetrable by light beams of a particular wave length or is provided with an opening for a light source to make possible a photochemical polymerization.

In the following, the invention is described with the aid of embodiments of the device which are reproduced in the drawings. FIGS. 1–4 show various respective embodiments of the extruder in cross-section for the introduction of material.

The extruder comprises a housing 1 that has a plurality of axial segments 2 positioned one behind the other with seals positioned between them. Heating and/or cooling devices 3 are located in the segments 2 and make control at a particular temperature possible. Two screw shafts 5 are arranged side by side within the housing and are driven by a motor or hydraulic device which is not shown. The screw shafts 5 consist of alternate feeding segments 6 and kneading segments 7 wherein the latter can be formed with either three-point or two-point segments. At the exit end, the housing 1 has a forming head 8 for the formation of one or more strands.

At the driven end, the housing has an inlet opening 9 into which a channel 10 opens. A storage container 11 for the plastic binder, for example a polymer, and a storage container 12 for the crystalline explosive, hexogene, octogene, or mixture of the same, are coupled to the channel 10 as shown in FIG. 1. A feed device 12 or correspondingly 14 in the form of a screw or spiral feeder is positioned between the respective storage containers 11 and 12 and the channel 10. Downstream of the inlet opening 9, the housing further includes a supplementary opening 14 for a solvent or the like. At a further downstream position a suction opening 16 is arranged for excess solvent. The opening 16 is connected to a vacuum pump 18 by means of a cooler and a degasser 17.

At the beginning of operation, the feeding device firstly is energized in order to add the plastic from the storage container 11 through the inlet opening 9. The charging of the plastic continues as long as the screw shafts 5 reciprocate in the housing without friction. Then, the feed device 14 is placed in operation in order to conduct the crystalline explosive material from the storage container 12 through the channel 10 into the inlet opening 9 whereby the revolutions of the feeding device 12 are steadily increased, and at the same time, the revolutions of the feeding device 13 are decreased in order to produce the desired mixture ratio. Further, a solvent can be added by means of the supplemental opening 15. Excess solvent is removed from the extruder by means of the suction opening 16 and is recirculated again.

Figure 2:
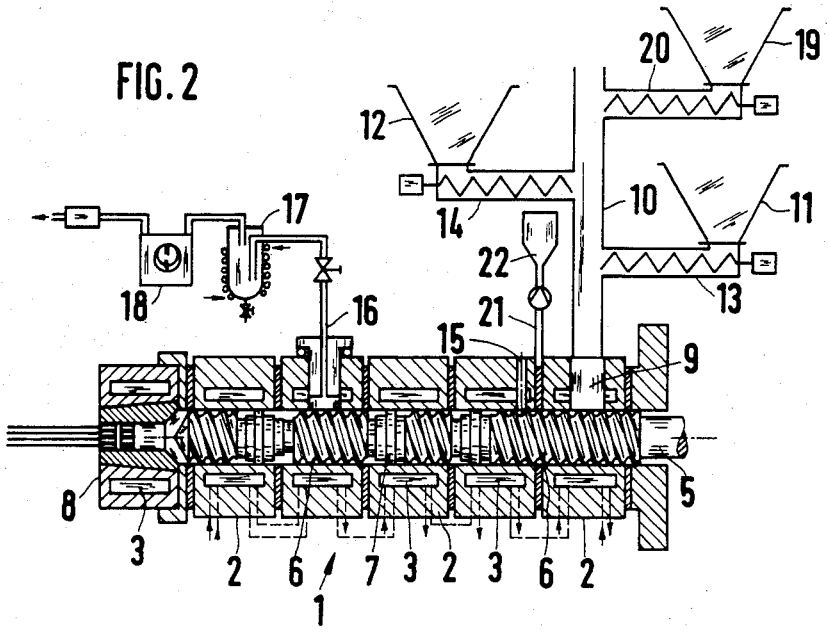

The embodiment of the invention according to FIG. 2 differs from that of FIG. 1 in that the channel 10 is connected with still a further storage container 19 for supplementary materials, such as nitrocellulose or the like. Also, a feeding device 20 is associated with this storage container. Further, adjacent the supplemental opening 15 for the solvent, there is still another conduit 21 for a softener held in a container 22.

Figure 3:
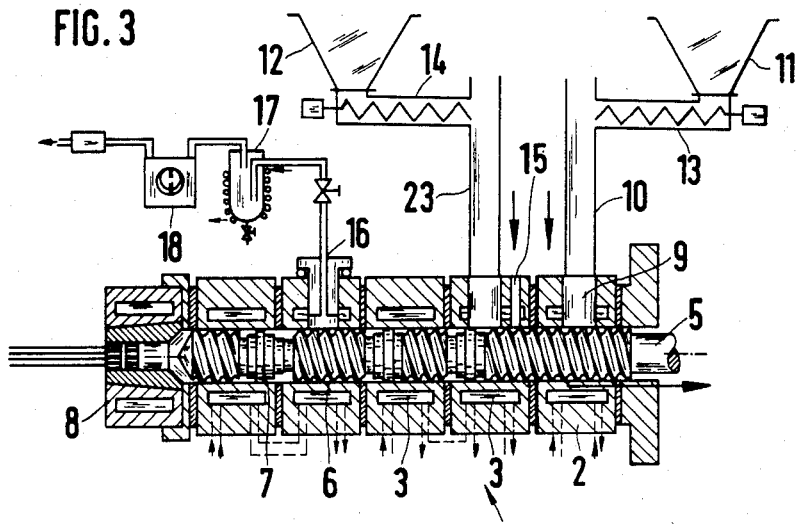

In the embodiment according to FIG. 3, the introduction of polymer from the container 11 and the channel 10 is again accomplished through the entry opening 9. The container 12 for the crystalline explosive on the other hand is connected downstream to its own channel 23 with a further entry opening 24. Here also a supplemental opening 15 for the solvent and/or the softener can be provided, in which case, the opening is arranged between the two entry openings 9 and 24.

Figure 4:
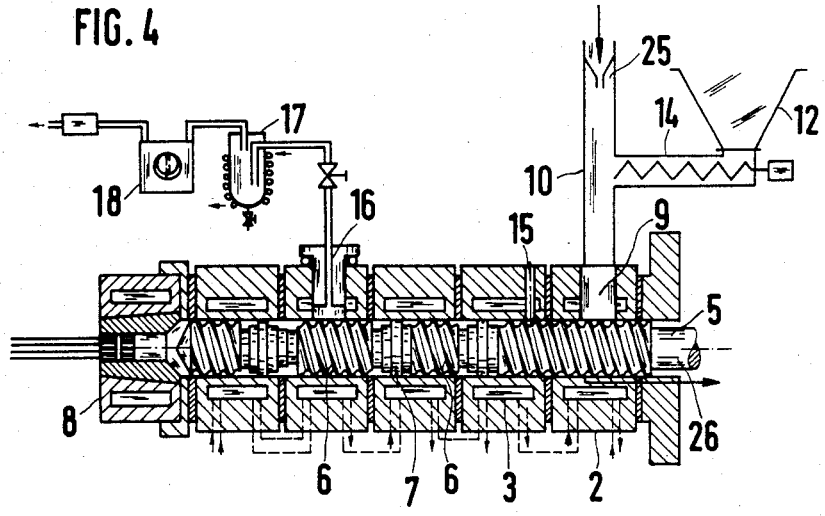

In FIG. 4, the storage container 12 with the explosive material and the feeding device 14 is again recognized. In this embodiment, the polymer is added as a water- or solvent-based suspension into the channel 10 at 25. Further, the extruder at its driven end, is provided with a drainage conduit 26 for draining off water or correspondingly for squeezing off excess solvent.

We claim:

1. A method of continuously extruding plastically bonded propulsion powder from crystalline explosives in an extruder of the type having screws rotating in a housing and wherein the housing has at least two openings provided in axially spaced relationship therein, one of the openings being provided to admit the plastic binder and the crystalline explosive material and another opening downstream thereof, said method comprising the steps of:

(a) introducing the plastic binder through said one opening to achieve a floating condition for the rotating screws wherein friction between the housing and the screws is minimized, (b) after the screws have achieved this floating condition introducing the propulsive crystal and explosive material so as to reduce the ratio of plastic binder to crystalline and explosive material and increase the content of crystalline and explosive material in the product, (c) continuing to mix some plastic binder with the crystalline and explosive material in order to continuously provide this increased crystalline content of the product in a continuously operated extruder.

2. The method method of claim 1 wherein said floating condition for said screws achieved by said step of initially introducing the plastic binder is further improved by heating the plastic binder in the extruder to a temperature of approximately 130 C., and then allowing the plastic binder to cool in the extruder to approximately 100 C. prior to introducing the crystalline explosive material.

3. The method method of claim 1 wherein the further step is provided for in the continuously operating extruder of introducing a solvent through said another opening.

4. The method method of claim 1 wherein the plastic binder is softened by an additional step, that of introducing a solvent to the mix of plastic binder and explosive material.

5. The method method of claim 4 wherein the mix of plastic binder and explosive material before introducing solvent is approximately 4–6% binder.

6. The method method of claim 4 wherein the additional step is provided of suctioning excess solvent through an opening in the extruder downstream of the location where the solvent is introduced.

7. The method method of claim 1 wherein the percentage of plastic binder relative crystalline explosive material content of the product resulting in step (c) is 6% or less.

* * * * *